United States Patent [19]

Clark

[11] 3,955,643

[45] May 11, 1976

[54] FREE FLOW SOUND ATTENUATING DEVICE AND METHOD OF MAKING

[75] Inventor: Raymond C. Clark, Lake Forest, Ill.

[73] Assignee: Brunswick Corporation, Skokie, Ill.

[22] Filed: July 3, 1974

[21] Appl. No.: 485,602

[52] U.S. Cl. ..... 181/42; 29/157 R; 181/35 C; 181/48

[51] Int. Cl.[2] ..... F01N 1/04

[58] Field of Search ..... 181/42, 46, 48, 59, 181/47, 41, 33 G, 35 C; 23/288 F; 29/157 R

[56] References Cited

UNITED STATES PATENTS

| | | | |
|---|---|---|---|
| 1,811,762 | 6/1931 | Schnell | 181/42 |
| 2,043,731 | 6/1936 | Bourne | 181/42 |
| 2,326,612 | 8/1943 | Bourne | 181/48 |
| 3,231,520 | 1/1966 | Leak | 23/288 F UX |
| 3,502,171 | 3/1970 | Cowan | 181/42 X |
| 3,734,234 | 5/1973 | Wirt | 181/33 G |
| 3,791,483 | 2/1974 | Vasiljevic | 181/42 |

FOREIGN PATENTS OR APPLICATIONS

| | | | |
|---|---|---|---|
| 1,196,877 | 7/1965 | Germany | 181/33 G |
| 829,012 | 2/1960 | United Kingdom | 181/71 |
| 733,329 | 7/1955 | United Kingdom | 181/42 |

*Primary Examiner*—John F. Gonzales
*Attorney, Agent, or Firm*—D. S. Olexa; S. L. Epstein; J. G. Heimovics

[57] ABSTRACT

An improved sound attenuating device characterized by several novel structures which include (1) a foraminous conduit covered by (2) a layer of sound absorbing material of increasing static flow resistance from the inlet end to the outlet end, and (3) a housing surrounding the conduit and defining a plurality of quarter-wave standing wave cavities in series after the inlet end in operative association with the covered conduit. The present structure provides an attenuating device having a continually changing flow resistance to match the decreasing sound pressure level of the fluid flow passing through the attenuator. The structure takes advantage of the interaction that exists between the sound pressure level and changes in the static and dynamic flow resistance, such that for decreasing sound pressure levels, the dynamic flow resistance will be maintained at an optimum for the system by increasing the static flow resistance.

44 Claims, 16 Drawing Figures

FREE FLOW SOUND ATTENUATING DEVICE AND METHOD OF MAKING

BACKGROUND OF THE INVENTION

This invention relates to an improved sound attenuating device in particular to an improved muffler system for fluid flows.

Present attenuators and muffler systems utilize baffle systems, retroverted systems or expansion chambers with the sound pressure level of the fluid flow through the muffler system generally decreasing continually from the inlet of the muffler to the outlet of the muffler. Because of the particular structures of the prior art attenuators and muffler systems, these structures have fixed static flow resistance to the fluid flowing therethrough.

According to sound attenuating theory, maximum sound attenuation occurs when the sound pressure level is matched with the flow resistance of the sound absorbing features of the attenuator. As the sound pressure level in a gas flow decreases as it proceeds through prior art attenuators having a fixed flow resistance, the decrease in sound pressure level of the gas flow is matched at only discrete levels of static flow resistance.

There is no suggestion in the prior art that an interaction exists between the sound pressure level of the gas flow to be attenuated and the changes in the static and dynamic flow resistance, such that for decreasing sound pressure levels, the dynamic flow resistance should be maintained at an optimum for the system, by increasing the static flow resistance. Accordingly, an attenuating device having a changing flow resistance to continually match the decrease in sound pressure level is not known in the prior art.

The present invention is directed in particular to this problem and describes a sound and noise attenuating device for use with flowing gas systems, wherein the flow resistance is constantly varied to match the decrease in sound pressure level in order to obtain maximum attenuation. In particular the invention is directed to a free flow sound attenuating device wherein the sound attenuated encompasses sound in a flowing gas having a decreasing sound pressure level as it passes through the attenuator. The sound absorbing features of the attenuator of the present invention are structured so that the flow resistance changes to match the decreasing sound pressure level of the flowing gases. The invention is particularly useful, but not limited to, flowing gases of single phase. By single phase it is meant flow comprising substantially 100 percent gaseous state with little or none of the flow in a liquid state. The device may be used for intake and exhaust gas flow systems such as mufflers and resonators for internal combustion engines.

It must be noted that this invention is particularly concerned with the change in sound pressure level and not sound power. Sound power is a measure of the total sound radiating from a device whereas sound pressure level is the strength of a sound wave after it travels a specified distance from the sound source. Therefore, if the sound pressure level can be controlled, the amount of decrease in sound power is a function of the efficiency of an attenuator, with a desired decrease in sound power being easily corrected by increasing the size and capacity of the attenuator.

SUMMARY OF THE PRIOR ART

Free flow or straight through sound attenuating devices are known in the art, and by free flow it is meant those devices where the flowing gas passage is direct and open with minimal back pressure developed as compared to devices where the flowing gas must pass through a multi-directional baffle system, retroverted systems, or through expansion chambers. Prior art devices have used resonators of the Helmholtz type separately or in combination with baffled systems for attenuating sound in exhaust gas flows for internal combustion engines, blower duct systems, fuel burning systems, etc. The art also discloses using a single Helmholtz resonator for tuning out a specific frequency or multiple resonators for tuning out a multiple of frequencies, such that sound accompanying such gas flows have sound removed by the action of certain frequencies resonating in the Helmholtz chamber. Whether single or multiple resonators are used the sound attenuation is dependent on the frequency characteristics of the single resonator or the sum of the frequency characteristics for multiple resonators.

As noted above, a major problem in the art occurs with a continually decreasing sound pressure level as flowing gases proceed through an attenuator. Heretobefore, prior art structures directed their attention to devices having a flow resistance matching the sound pressure level at only discrete sound pressure levels.

In addition, for large gas flows at high sound power levels and accompanying high sound pressure levels, the prior art sound attenuating devices have necessitated very large units in absolute terms, increasing the problem of the design, handling and installation. This is particularly a problem with free flow attenuating structures where unless large in size the efficiency of the attenuator is not capable of attenuating sound power to an acceptable level to the general public or for industrial applications.

SUMMARY OF THE INVENTION

With particular reference to the problems noted above, it is a general object of the present invention to provide a sound attenuating device that has sound absorbing features which vary in static flow resistance matching the sound pressure level present in the flowing fluid present at any particular location in the attenuator. The attenuator of the present invention has varying flow resistance increase in terms of static rayls from the inlet end to the outlet end, to provide a constant level of dynamic flow resistance, as seen by the flowing gas, for the full length of the attenuator. Accordingly, maximum attenuation and efficiency is maintained for the length of the attenuator.

Furthermore, recognizing that prior art sound attenuators could be efficient when subjected to gas flows having a high sound pressure and level, they did so at the expense of being very large in size and weight. In addition, since the efficiency of the sound attenuator is governed by the matching of the sound pressure level with the flow resistance of the attenuator, the prior art devices attempted to compensate, for a decreasing sound pressure level in the flowing gas, by utilization of various arrangements, both simple and complex, of Helmholtz type resonators, single or multi-dimensional baffle systems, retroverted systems, or expansion chambers. Accordingly, each one of these systems resulted in a device having a discrete number of different static flow resistances. The present invention avoids this problem by providing a foraminous conduit covered by a layer of sound absorbing material continuously increasing flow resistance from the inlet end to the outlet end of the attenuator. By continuously increasing static flow resistance, the attenuator impedance is matched to the continuously decreasing sound pressure level of the gas flow as it proceeds through the attenuator. This results in a maximum efficiency free flow device of simple construction.

Moreover, with prior art sound attenuators utilizing baffling, retroverted flow patterns, resonators and expansion chambers, a great number of production sequences were required in their manufacture. Accordingly, another object of this invention is to provide a sound attenuator which is simple in structure, easier to manufacture and easier to maintain than devices heretofore known in the art. In addition the devices of the present invention is lower in cost and more durable in operation than prior art devices subject to equivalent sound pressure level and attenuation characteristics.

Furthermore, although the prior art teaches free flow devices, the structure of the present invention provides an improvement over them in its utilization of a central foraminous tube which may have an internal layer of metal fibers having a special coating. The coating applied will depend on the function it is to serve one example being a material in an oxidized or unoxidized state resistant to corrosive substances that may be present in the flowing gas. The foraminous tube operating in conjunction with the high frequency resonator permits greater decibel attenuation hereto before not known in the art or expected.

It is another object of the invention to provide for a more compact ruggedly constructed attenuator that has improved erosive, corrosive and temperature resistance characteristics.

Additional objects and advantages of the invention will become apparent to those skilled in the art from the following discussion of the several illustrative embodiments thereof, which will be described in connection with the attached drawings, in which.

Figure 1:
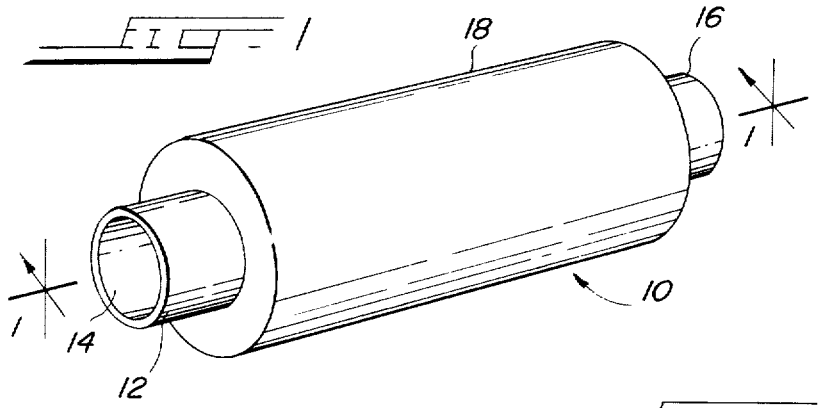
FIG. 1 is a perspective view of one form of the attenuator embodying the invention.
Figure 2:
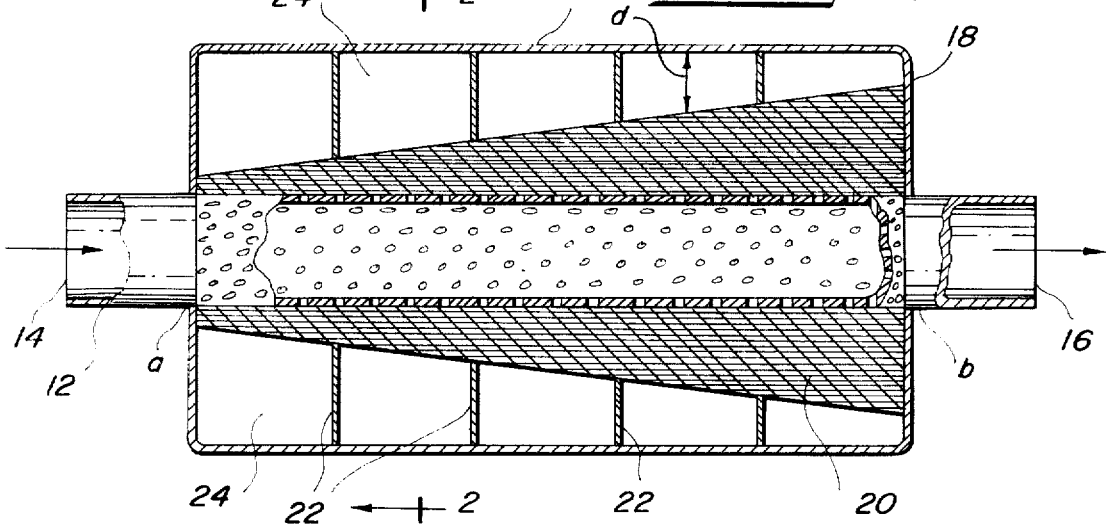
FIG. 2 is a longitudinal cross-section along the centerline of FIG. 1 taken along lines 1—1 showing a central foraminous conduit increasing in thickness.
Figure 4:
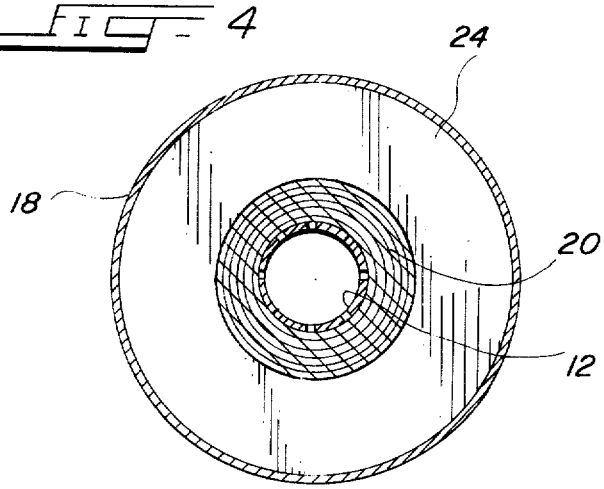
Figure 2A:
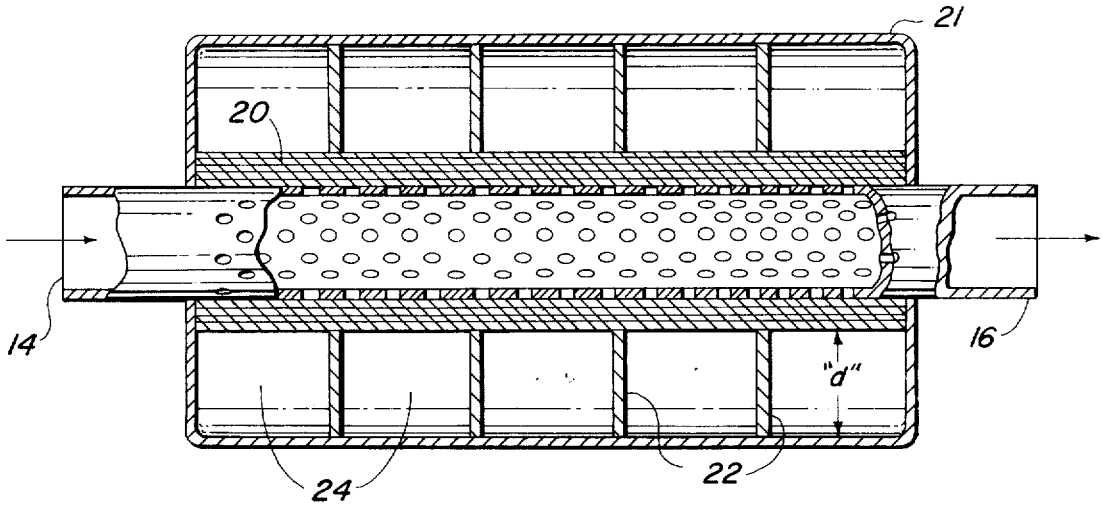
Figure 14:
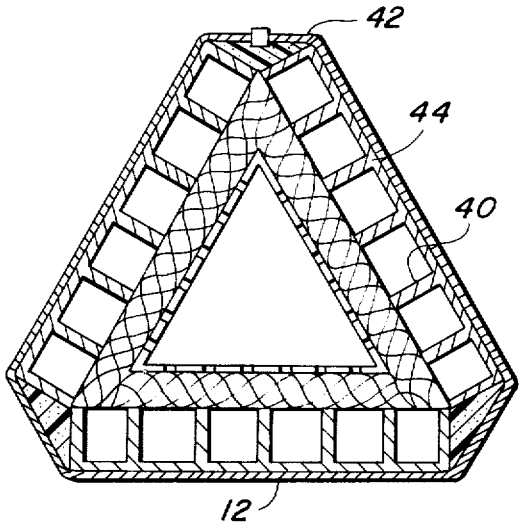
Figure 15:
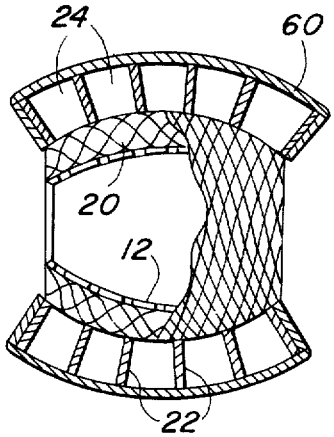
Figure 3:
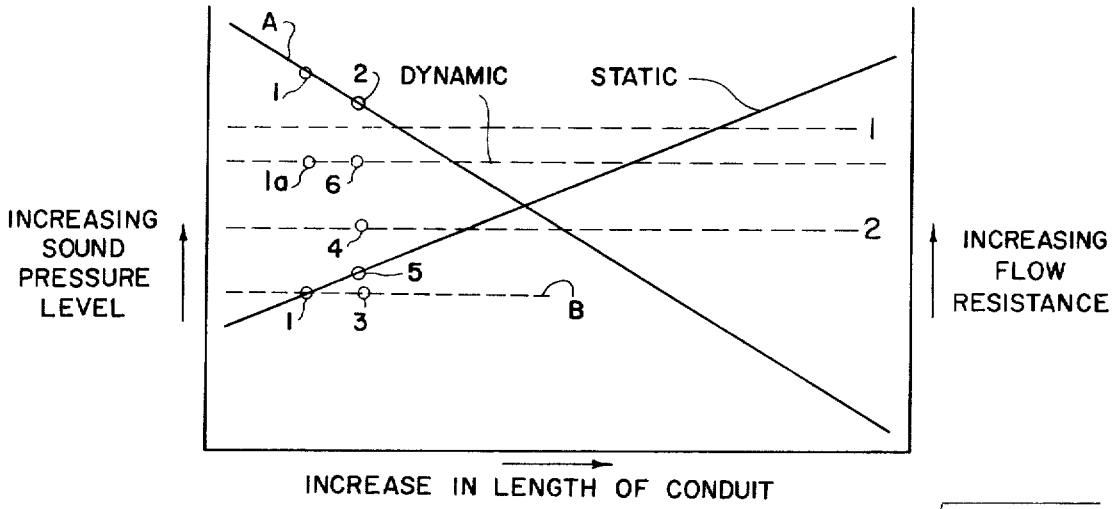
Figure 6:
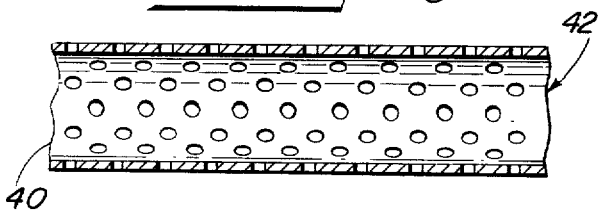
Figure 5:
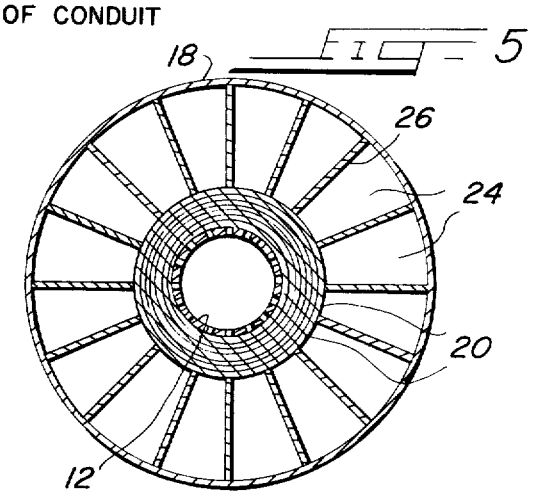
Figure 7:
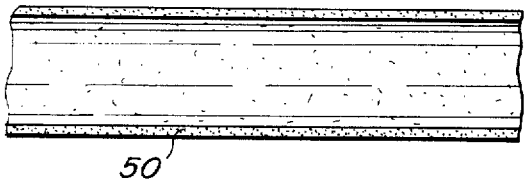
Figure 9:
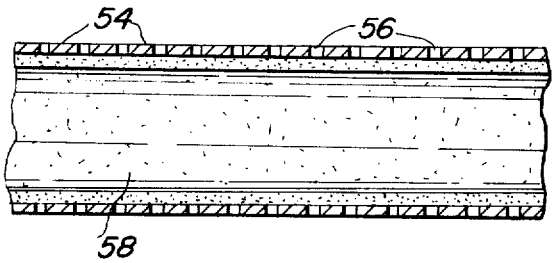
Figure 8:
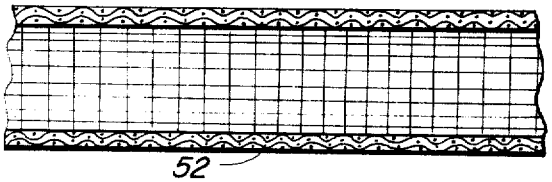
Figure 10:
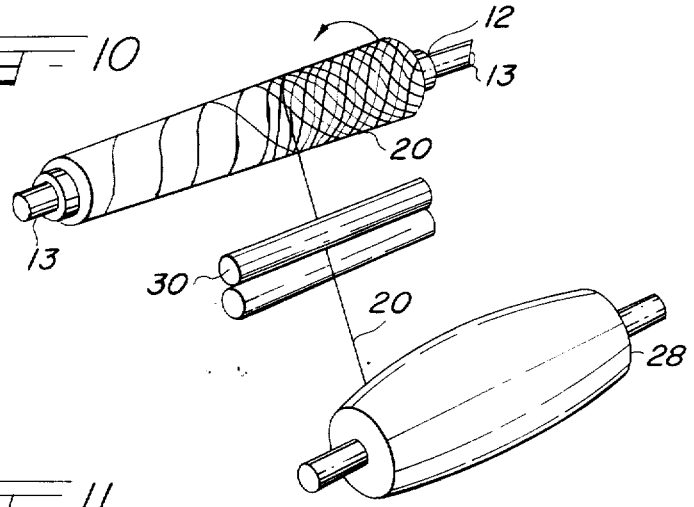
Figure 11:
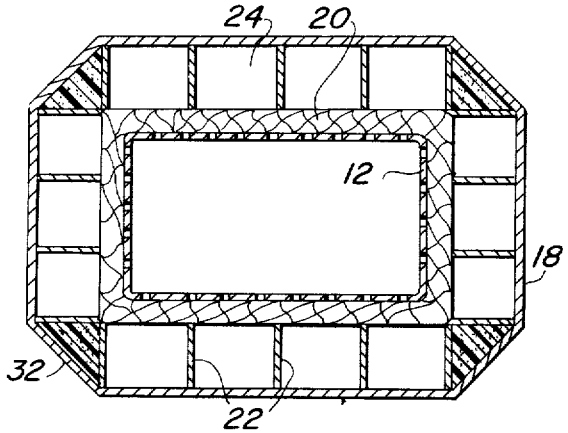
Figure 12:
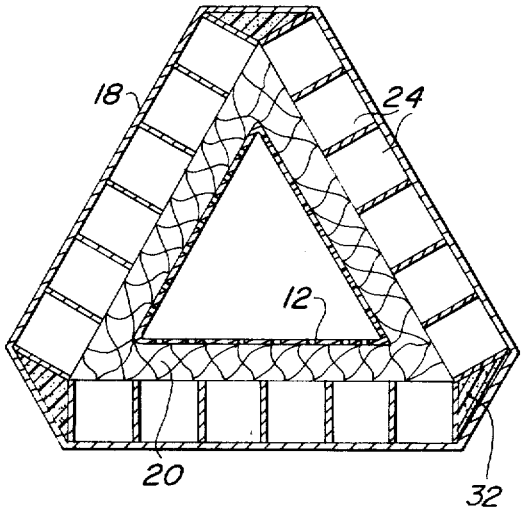
Figure 13:
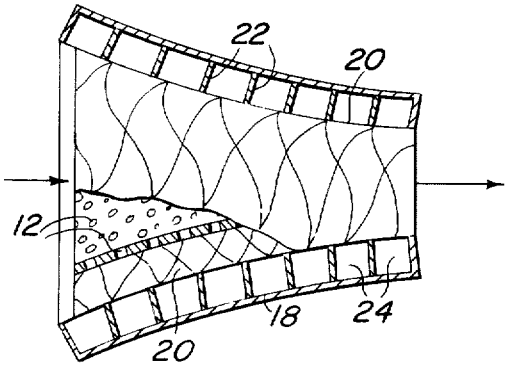

FIG. 2*a* is a longitudinal cross-section along the centerline of FIG. 1 taken along lines 1—1 showing a central foraminous conduit having a constant thickness;

FIG. 3 is a graph plotting the decrease in sound pressure level and increase in flow resistance of the conduit versus increases in conduit length;

FIG. 4 is a cross-section along lines 2—2 of FIG. 2 taken perpendicular to the centerline of the attenuator;

FIG. 5 is a cross-section similar to FIG. 3 showing a variation in the arrangement of the quarter-wave standing wave cavities;

FIG. 6 shows an embodiment of the foraminous conduit of the present invention sectioned along its centerline;

FIG. 7 shows a second embodiment of the foraminous tube sectioned along its centerline;

FIG. 8 shows a third embodiment of the foraminous tube sectioned along its centerline;

FIG. 9 shows a fourth embodiment of the foraminous tube sectioned along its centerline;

FIG. 10 shows a schematic in perspective of one method of making the covered foraminous conduit of the present invention;

FIG. 11 is a cross-section taken perpendicular to the centerline of the attenuator showing a square foraminous conduit construction of the present invention;

FIG. 12 is a cross-section taken perpendicular to the centerline of the attenuator showing a triangular foraminous conduit construction of the present invention;

FIG. 13 is a longitudinal cross-section taken along the centerline of the attenuator showing a curvilinear cone-shaped foraminous conduit construction of the present invention;

FIG. 14 is a cross-section taken perpendicular to the centerline of the attenuator showing a variation of FIG. 12 with the honeycomb material having an intergral backing; and FIG. 15 is a longitudinal cross-section taken along the centerline of the attenuator showing another curvilinear shaped foraminous conduit construction of the present invention.

DETAILED DESCRIPTION OF THE PREFERRED EMBODIMENT

In general terms the basic features of the preferred embodiment of this invention comprise (1) a foraminous conduit covered by (2) a layer of sound absorbing material increasing in static flow resistance from the inlet end to the outlet end, and (3).a housing surrounding and secured to the conduit and defining a plurality of quarter-wave standing wave cavities in series after the inlet end in operative association with the covered conduit.

FIG. 1 shows a perspective view of a sound attenuator according to the present invention. The attenuator 10 has a central foraminous conduit 12 having an inlet end 14 and an outlet end 16, which inlet and outlet end can be connected to conventional intake or exhaust pipes according to the particular application. The central conduit 12 is generally described as a foraminous tube, meaning a conduit having porosity such that the flow resistance across the conduit is selected relative to the acoustical impedance of the gas and sound pressure level entering the conduit. That is, it is necessary that the conduit not be totally impervious to a flow of gas. The flow resistance may be uniform or non-uniform along the conduit length, a uniform distribution being preferable because of its lower manufacturing cost and a non-uniform distribution being preferable because of its maximizing sound attenuation. The choice of material for the conduit may be made of a number of materials some examples being, laminated screen structure, perforated tube, metal fiber web, knitted fiber or wire material, compacted fiber, foamed metals or non-metals, glass fiber, plastic fiber, porous ceramics or combinations thereof. However, it is noted that the choice of material for the conduit will be related to its particular application. As an example, for a flow of gas at a high temperature a plastic may be used. In addition, for gas flows containing large surges of pressure level increases, a material capable of withstanding a great pressure drop across the conduit wall will be necessary.

Whatever the situation it is obvious that one skilled in the art can determine the material most suitable for the particular gas flow by application of known engineering principles.

A number of different conduit structures may be used depending on the physical characteristics of the gas flow, four structures are shown as examples in FIGS. 6, 7, 8 and 9.

FIG. 6 shows a preferred embodiment of the central foraminous portion of conduit 12 of the present invention comprising a tubular section 40 made of perforate plate having a plurality of holes 42. These holes may all have a similar or different diameters.

FIG. 7 shows another embodiment of the central foraminous portion of conduit 12 comprising a tubular metal structure section 50 made of metal fiber web or mesh structure, which web and mesh structures may be produced by processes known in the art as described in U.S. Pat. Nos. 3,505,038, 3,127,668 and 3,469,297 each of which is incorporated by reference. The mesh and web structures can be made of metal fiber made in accordance with the descriptions given in U.S. Pat. 3,394,213; 3,505,038; 3,505,039; 3,698,863; 3,379,000 and 3,277,550 each of which is also herein incorporated by reference. It is also possible to provide chopped fibers useful in the tubular structure in accordance with U.S. Pat. No. 3,504,516. The above listed patents being owned by the assignee of the present invention.

In addition, it is also possible to use coated metal fibers in accordance with U.S. Pat. Nos. 3,698,863 and 3,505,038. Other ways of producing the fibers and fiber webs for the tube of this invention are known in the prior art and such other references are not excluded by the citing of the above references which are given as example only.

It is noted that the tubular structure made of fiber web or mesh as described above is desirable to other structures, since it has been found that this structure provides the greatest amount of frictional losses for optimum sound absorption.

FIG. 8 shows a tube made of a screen-like material 52 which may be used either separately or in combination with the tube shown in FIG. 6, the controlling factor being whether the outer shell 18 (See FIG. 1) of the structure has sufficient rigidity to provide support for the screen-like tube. An equivalent form for the screen-like material would be highly perforated tube or mat structure tubular in shape and having an external diameter approximately equal to the internal diameter of the tube.

FIG. 9 shows another embodiment of the central foraminous portion of conduit 12, wherein a conduit 54 (in accordance with the conduit shown in FIG. 6) has ports 56 of similar diameter shown large for purposes of illustration. It also has metal, organic or ceramic fibers 58 provided on the internal surface thereof, the fibers having a protective coating of oxidation-catalyst such as nickel, platinum, aluminum oxide, copper oxide, etc.

Referring to FIG. 1 and FIG. 2 whatever the form of the conduit used, it is covered by a layer of sound absorbing material 20 with a constant thickness increasing density layer from points *a* to *b* as in FIG. 2*a* or has a constant density with increasing thickness of sound absorbing material from point *a* to point *b* as in FIG. 2. In either arrangement, a covered conduit is defined having a sound absorbing layer increasing in static flow resistance from point *a* to point *b*. The covered conduit is surrounded by and secured to a housing or outer shell 18 by plates 22 which together with the housing 18 define quarter-wave standing wave cavities 24. It is noted that the foraminous portion of conduit 12 is foraminous only for that portion of the conduit associated with cavities, this being indicated between points *a* and *b*. The remaining portions of conduit 12 being non-porous to fluid flow. It is further noted that the conduit 12 is only covered by sound absorbing material along its foraminous portion as shown in FIG. 2. The housing 18 encloses only the foraminous portion of conduit 12 and is secured to the inlet and outlet ends projecting a short distance for easy attachment to the device with which it will be used. The outer shell 18 is of a conventional nature, one example being sheet metal.

The flowing gas having concomitant sound to be attenuated enters the sound attenuator 10 at the inlet end 14. The gas stream then passes through foraminous conduit 12 and by annular high frequency, quarter wavelength depth tuned cavities 24 which communicate with the conduit through the layer of sound absorbing material 20. The alpha character *d* in FIG. 2 indicates the depth of the quarter wavelength cavity measured from the exposed surface of the sound absorbing material 20 to the inner wall 19 of housing 18.

It is noted that any sound absorbing material exhibits both static flow resistance, resulting from flow only in one direction through the material, and a dynamic flow resistance resulting from pulsating flow across the material. Accordingly, for a specified sound pressure level in the gas flow the sound absorbing material will exhibit a static and dynamic resistance. Decreasing the sound pressure level will result in the material exhibiting a decrease in the dynamic flow resistance with the static flow resistance remaining the same. In other words the static flow resistance is affected by the amount or density of the sound absorbing material used. What is desired for maximum sound attenuation is the matching of the covered conduit's dynamic flow resistance to the sound pressure level at that particular location in the sound attenuator. This matching is achieved by adjusting the static flow resistance of the sound absorbing material at the particular location in the sound attenuator.

FIG. 3 is a graph plotting on the left ordinate sound pressure level versus increasing conduit length and on the right ordinate conduit flow resistance versus increasing conduit length. In any sound attenuating device the gas flow enters the device at a certain sound pressure level and upon proceeding through the device, the sound pressure level decreases with accompanying sound attenuation. FIG. 3 depicts this affect by line A indicating a decrease in sound pressure level with an increase in length of the sound attenuator plotted with respect to the left ordinate. Since it is desired to have the static flow resistance of the attenuator match the decrease in sound pressure level, the present invention provides for structure having a sound absorbing layer increasing in static flow resistance with an increase in conduit length. This is depicted by the "static" line on FIG. 3 plotted with respect to the right ordinate. As noted earlier, for maximum sound attenuation the sound pressure level should be matched to the dynamic flow resistance of the sound absorbing material. In addition, maximum efficiency of the attenuator occurs when the dynamic flow resistance across the sound absorbing layer is at an optimum. For a given sound pressure level indicated by point 1 on line A and static flow resistance indicated by point 1 on the static line, there will be a specified dynamic flow resistance, indicated by point 1a on FIG. 3, the dotted line being the effective dynamic flow resistance. When the gas flow proceeds through an attenuator having a fixed static flow resistance as indicated by dotted line B on FIG. 3, the sound pressure level will decrease to some point 2 with the static flow resistance remaining constant as at point 3. In this situation the dynamic flow resistance will decrease to some point 4. However, with a sound pressure level as at point 2, if the static flow resistance is increased such as at point 5, the dynamic flow resistance will increase. A sufficient increase in the static flow resistance will bring the dynamic flow resistance to point 6 which is observed to be equal to that at point 1a. In other words the dynamic flow resistance can be maintained at a constant level for decreasing sound pressure levels if the static flow resistance becomes increasingly larger. Since the efficiency of the attenuator is related to the optimum dynamic flow resistance of the system, the present invention provides an optimum efficiency attenuator for a given sound pressure level drop.

In order to obtain the full effect of the dynamic flow resistance across the sound absorbing material, quarter-wave standing wave cavities are placed behind the sound absorbing material and enclosed by the outer shell 18. The use of quarter-wave standing wave cavities assures that the sound particle pressure level at the absorbing material will be substantially at a zero mode with the sound particle velocity being at its maximum. Maximum sound velocity through the sound absorbing material assures maximum effect of the dynamic flow resistance. The quarter-wave cavities are preferably tuned by making *d* in FIG. 2 an odd multiple of one-quarter wave length of the frequency of interest.

Regarding the structure of the quarter-wave cavities, FIG. 2 shows the cavities to be decreasing in volume from point *a* to point *b* due to the increasing thickness of the sound absorbing material 20. The thickness of the absorbing material in FIGS. 2 and 2*a* is exaggerated for clarity. The thickness can be as little as a few thousandths of an inch or smaller to a few tenths of an inch or larger. The static flow resistance of the sound absorbing layer 20 may be increased by increasing the density of the material applied by keeping the thickness of the material constant as in FIG. 2*a*, or by keeping the density of the material applied constant and increasing the thickness of the material as in FIG. 2. For a constant thickness layer 20 as shown in FIG. 2*a*, the depth *d* of the quarter-wave cavities is a constant with a correspondingly large attenuation of a narrow bandwidth around the frequency to which the cavities are tuned. For an increasing thickness layer 20 is shown in FIG. 2 the depth *d* continually varies and accordingly broadens the band of attenuation but lessens the magnitude of attenuation.

It is noted that the above improvements and discoveries are not disclosed or suggested in prior art structures. The improvement is believed to be the result of matching static flow resistance to decreasing sound pressure levels to assure maximum effect of an optimum level of dynamic flow resistance across the sound absorbing material 20.

The acoustical impedance of fluid gases can range between 3 – 400 cgs. rayls, the following given as example only with impedance values for other gases available in standard reference books:

air at 6 psia and 1000°F – 10 rayls,
hydrogen at 14.7 psia and 0°C – 11.4 rayls,
air at 14.7 psia and 0°C – 42.86 rayls,
air at 55 psia and 800°F – 100 rayls,
air at 115 psia and 400°F – 250 rayls,
air at 100 psia and 100°F – 300 rayls,
Freon - 22 at 76 psia and 150°F – 380 rayls,
(the condition of Freon inside of a sealed refrigeration unit)

The matching resistance of the foraminous portion of conduit 10 and sound absorbing material 20 is also measured in units of rayl being defined as the change in sound pressure level drop (measured in dynes/cm$^2$) across the conduit wall divided by the velocity of fluid flow (measured in cm/sec). A unit of rayl is then dynes-sec/cm$^3$.

It has been shown that if the effective resistance of the conduit 12 and sound absorbing material 20 is too low, the quarterwave standing wave will be established but maximum sound absorption will not occur. If the sound absorbing material's resistance is too high the quarter-wave standing wave will not be strongly established and sound absorption will again be low. The prior art literature indicates that a high sound pressure level present will cause the effective acoustical impedance of the material used to increase, "high" being defined as above 130 db, with particular concern in the 140-160 db range. Any sound pressure level below 130 db being defined as low. If the choice of material for sound absorbing layer 20 is metal fiber or metal fiber web made according to the prior art discussed earlier, it has been found that the effective resistance of this material increases for high frequency sound at sound pressure levels over 130 db.

Accordingly, in order to maintain a constant dynamic flow resistance the static flow resistance must be increased by either increasing the density of the sound absorbing material along the length of the attenuator for constant thickness absorbing material or increasing the thickness of the sound absorbing material along the length of the attenuator for constant density absorbing material. There is no suggestion or disclosure in the prior art that an interaction exists between the sound pressure level and the changes in static and dynamic flow resistance, such that for decreasing sound pressure levels the dynamic flow resistance should be maintained at an optimum for the system by increasing the static flow resistance. This effect has not heretobefore been recognized or utilized.

FIG. 4 is a cross-section along lines 2—2 of FIG. 1 and clearly shows the arrangement of the sound absorbing material 20 around the central foraminous conduit 12. This section indicates the simplicity of the structure of the present invention with corresponding simplicity in methods of manufacture, one shown in FIG. 10. The conduit 12 is placed preferably on a rotatable mandrel 13. The sound absorbing material 20 in forms such as filament, tow, tape, sheet, etc. is mounted on a spindle 28 and passed through a tensioning device such as a roller assembly 30 well known in the spinning art. The absorbing material can then be applied to the conduit in a spiral fashion as shown to a predetermined quantity, weight, constant thickness, or increasing thickness from one end of the covered conduit to the other. It may be desirable to assure the covered conduit remains in a stable integral form depending on the sound absorbing material used. Accordingly, if the sound absorbing material is a metal fiber, after application of the metal fiber to the conduit 12, the covered conduit may then be sintered by known techniques. The sintering binds the fibers to define an integral structure. The sintered conduit may then be further compression rolled by use of an external roll to increase the density of the layer applied. The external wall can be applied to one end of the sintered conduit with greater force than the other thereby causing one portion of the conduit to have a sound absorbing layer of greater density than the other. By this technique it is possible to vary the density of the sound absorbing layer over the length of the conduit uniformly or non-uniformly.

If the sound absorbing material is a non-metal a bonding agent may be used to hold the fiber in an integral structure or a screen material may be used, as one example, wrapped tightly around the sound absorbing material applied to hold the material in an integral structure. In either case, the covered conduit should be tested for permeability by checking the flow resistance.

The sound absorbing material may be made of a number of materials and a variety of shapes depending on the sound attenuating characteristics desired. The absorbing material can take on such forms as filament, tow, tape, sheet, etc. made of a number of materials such as metal fiber, organic fiber, glass fiber, ceramic fiber, knitted fiber, plastic fiber, compacted fiber, foamed metals or non-metals, porous ceramics, nylon polyimide, polyvinyl chloride, polyolefins, or combinations thereof. Accordingly it becomes possible to control the density of the sound absorbing material applied on the conduit to thereby control and predetermine the nature of the static flow resistance along the length of the conduit. It becomes clear then that this method has an advantage in that different shaped conduits, cylindrical, square, triangular, hexagonal, spheres, oblates, curvilinear cones, etc. as shown in FIGS. 11, 12, 13 and 15 given as example only, show the great flexibility in shapes that are possible with the attenuator achieved by the simplicity of the structure of the present invention. It is obvious that many other shapes and forms are comprehended within this disclosure. The invention therefore has as one advantage the providing of a low cost attenuator with maximum flexibility of shape. The ability to wind or wrap by applying a predetermined amount of sound absorbing material in this fashion around the central conduit allows the use as one method spinnings as a mandrel which is considerably easier to manufacture than making the attenuator from sections.

Although the method described shows a simpleway of providing a layer of sound absorbing material on the foraminous portion of conduit 12 other methods known in the art are equally applicable. For example, if the sound absorbing material is in the form of plastics or foamed materials the material may be foamed, flowed, molded or cast on the peripheral surface of the conduit. These methods along with others individually or in combination are equally envisioned in this invention as alternate methods of material application.

Another embodiment of the attenuator shown in FIG. 1 is that shown in FIG. 5 which is identical to the attenuator in FIG. 1, but which has in lieu of plates 22 the use of a honeycomb material 26 to define a great number of quarter-wave cavities 24 around the periphery and along the length of the covered conduit. It has been found that the honeycomb material can provide an increased sound attenuation effect over that obtained by the structure of FIG. 1. The honeycomb material can be of any material having structural integrity. The material chosen will obviously depend on the temperature and pressure of the gas flow, the material choice governed by known engineering criteria. It is also possible to use a honeycomb material made of injection molded plastic or die cast metal, one example shown in FIG. 14, having its back surface 44 acting as the outer shell 18 in FIG. 1. The honeycomb material 40 can then be secured by a strapping 42 or sheet metal, as shown in FIG. 14 to form an integral unit.

The particular frequencies and sound pressure levels generated by a sound source, will vary with style, size, etc. of the application. The maximum efficiency of the attenuator of the present invention will thus depend upon the exact frequency and sound pressure level characteristics of the sound source. Utilizing this data the frequencies to be used for tuning the quarter-wave cavities can be calculated by standard formulae as described in "The Theory of Sound," by John William Strut, Baron Rayleigh, published in 1894 and republished by Dover Publications, Inc. in 1945. Variations in gas flow volume and sound pressure level will obviously necessitate increases or decreases in the size and design of the attenuator. However, adjustments for these parameters are well known in the art.

FIGS. 11 and 12 are cross-sections taken perpendicular to the longitudinal axis of the attenuator, shows two other embodiments of the present invention being similar to that shown in FIGS. 1 and 2, the difference being that conduit 12 has a rectangular cross-section in FIG. 11 and a triangular cross-section in FIG. 12. The conduit 12 is covered as before with a layer of sound absorbing material 20, and surrounded by and secured to a housing or outer shell 18 by plates 22 which together with the housing 18 define quarter-wave standing wave cavities 24. The housing 18 encloses the entire foraminous portion of conduit 12 except for the inlet and outlet ends which project for a short distance for easy attachment to the device with which it will be used. Similarly, FIGS. 13 and 15 indicate two other variations of the embodiment shown in FIGS. 1 and 2 the difference again being in the cross-sections of conduit 12. FIG. 13 depicts a curvilinear cone-shape conduit with a partial cross-section taken along the longitudinal axis of the attenuator, the conduit 12 wrapped with sound absorbing material 20 in the fashion described above, and surrounded by a housing 18 defining quarter-wave standing wave cavities 24 operatively associated with the conduit through the wall of sound absorbing material. FIG. 15 shows a concave shaped conduit with a partial cross-section taken along the longitudinal axis of the attenuator, the conduit 12 wrapped with sound absorbing material 20 in a fashion as described by one of the methods above, and surrounded by a housing 60 defining quarter-wave standing wave cavities 24 operatively associated with the conduit through the wall of the sound absorbing material.

While the foregoing description sets forth the principles of the invention in connection with specific attenuators known in the art, the terms and expressions employed are terms of description in the art, and not of limitation, with no intention in using such terms to exclude any equivalent of the structures described. It is also understood that the description is made only by way of example and not as a limitation of the scope of the invention as set forth in the general aspects thereof and in the accompanying claims.

What I claim is:

1. A device for attenuating the sound level in a fluid flowing therethrough, comprising:

a conduit with one end an inlet and the other end the outlet and having a central foraminous portion;

a layer of sound absorbing material surrounding the foraminous portion of the conduit to define a covered conduit; the sound absorbing material having a static flow resistance continuously increasing from the inlet to the outlet of the covered conduit; and a housing surrounding the covered conduit and secured to the inlet and outlet to define a plurality of quarter-wave standing wave cavities in series after the inlet in operative association with the covered conduit.

2. The device of claim 1 wherein the depth of the quarter-wave standing wave cavities is an odd multiple of one-quarter wavelength of the frequency of interest.

3. The device of claim 1 wherein the foraminous conduit has an effective impedance in the range 3-30 cgs rayls.

4. The device of claim 1 wherein the foraminous conduit has an effective impedance in the range 31-100 cgs rayls.

5. The device of claim 1 wherein the foraminous conduit has an effective impedance in the range 101-400 cgs rayls.

6. The device of claim 1 wherein the foraminous conduit is a laminated screen structure.

7. The device of claim 1 wherein the foraminous conduit is a perforated tube.

8. The device of claim 7 wherein the perforated tube is made of metal with metal fiber in the openings.

9. The device of claim 1 wherein the foraminous conduit is a metal fiber web structure.

10. The device of claim 9 wherein the metal fiber web structure has the inside surface thereof covered with a layer of fibers having a protective coating.

11. The device of claim 10 wherein the fibers are made of metal.

12. The device of claim 10 wherein the fibers are of organic material.

13. The device of claim 10 wherein the fibers are of ceramic material.

14. The device of claim 10 wherein the protective coating is an oxidation catalyst.

15. The device of claim 1 wherein the sound absorbing material is made of filamentary material.

16. The device of claim 15 wherein the material is metal filaments.

17. The device of claim 15 wherein the material is fiberglass.

18. The device of claim 15 wherein the material is organic filaments.

19. The device of claim 1 wherein the sound absorbing material is knitted fabric.

20. The device of claim 19 wherein the fabric is formed from metal fibers.

21. The device of claim 1 wherein the layer of sound absorbing material has a constant thickness.

22. The device of claim 1 wherein the layer is a back and forth spiral overwrap of filaments.

23. The device of claim 22 wherein the filaments are metal.

24. The device of claim 23 wherein the filaments are sintered.

25. A device for attenuating the sound level in a fluid flowing therethrough, comprising:

a conduit with one end an inlet and the other end the outlet and having a central foraminous portion;

a layer of sound absorbing material surrounding the foraminous portion of the conduit to define a covered conduit, the sound absorbing material having a continuously increase density from the inlet to the outlet of a covered conduit and, a housing surrounding the covered conduit and secured to the inlet and outlet to define a plurality of quarter-wave standing wave cavities in series after the inlet in operative association with the covered conduit.

26. The device of claim 25 wherein the layer of sound absorbing material has a constant thickness.

27. The device of claim 25 wherein the layer is a back and forth spiral overwrap of filaments.

28. The device of claim 27 wherein the filaments are metal.

29. The device of claim 28 wherein the filaments are sintered.

30. A device for attenuating the sound level in a fluid flowing therethrough, comprising:

a conduit with one end an inlet and the other end the outlet and having a central foraminous portion;

a layer of sound absorbing material surrounding the foraminous portion of the conduit to define a covered conduit, the sound absorbing material continuously increasing in thickness from the inlet to the outlet of the covered conduit; and, a housing surrounding the covered conduit and secured to the inlet and outlet to define a plurality of quarter-wave standing wave cavities in series after the inlet in operative association with the covered conduit.

31. The device of claim 30 wherein the sound absorbing material has a static flow resistance increasing from the inlet to the outlet of the covered conduit.

32. The device of claim 30, wherein the sound absorbing material has an increasing density from the inlet to the outlet of the covered conduit.

33. A method of making a device for attenuating the sound level in a fluid flowing therethrough, comprising the steps of:

providing a conduit with one end being the inlet and the other end the outlet, the conduit having a central foraminous portion between the inlet and outlet;

applying a sound absorbing material on the periphery of the foraminous portion of the conduit to define a covered conduit, the sound absorbing material having a static flow resistance continuously increasing from the inlet to the outlet of the covered conduit;

providing a housing around the covered conduit, the housing secured to the conduit at the inlet and outlet ends, the housing defining a space between the covered conduit and the housing; and, providing a plurality of plates in the space between the covered conduit and inner surface of the housing to define a plurality of quarter-wave standing wave cavities in series after the inlet end in operative association with the covered conduit.

34. The method of making the device of claim 33 wherein the amount of sound absorbing material applied increases in thickness from the inlet to the outlet of the covered conduit.

35. The method of making the device of claim 33 further including the step of compression rolling the sound absorbing material with increasing pressure from the inlet end to the outlet end of the covered conduit.

36. A method of making a device for attenuating the sound level in a fluid flowing therethrough, comprising the steps of:

providing a conduit with one end being the inlet and the other end the outlet, the conduit having a central foraminous portion between the inlet and outlet;

applying a sound absorbing material on the periphery of the foraminous portion of the conduit to define a covered conduit;

providing a housing around the covered conduit, the housing secured to the conduit at the inlet and outlet ends, the housing defining a space between the covered conduit and housing;

compression rolling the sound absorbing material with increased pressure from the inlet to the outlet of the covered conduit, thereby increasing the density and static flow resistance of the material; and, providing a plurality of plates in the space between the covered conduit and inner surface of the housing to define a plurality of quarter-wave standing wave cavities in series after the inlet end in operative association with the covered conduit.

37. The method of making the device of claim 36 wherein the sound absorbing material has a static flow resistance increasing from the inlet end to the outlet end of the covered conduit.

38. A method of making a device for attenuating the sound level in a fluid flowing therethrough, comprising the steps of:

providing a conduit with one end being the inlet and the other end the outlet, the conduit having a central foraminous portion between the inlet and outlet.

spirally winding a filamentary material in a back and forth overlapped fashion on the exterior surface of the foraminous portion of the conduit to form a sound absorbing layer covering the conduit and having a preselected static flow resistance;

providing a housing around the covered conduit, and secured thereto at the inlet and outlet defining a space there between; and, providing a plurality of plates in the space between the covered conduit and the inner surface of the housing to define the plurality of quarter-wave standing wave cavities in operative association with the covered conduit

39. The method of claim 38 wherein the filamentary material is made from metal fibers.

40. The method of claim 39 wherein the metal fibers are sintered.

41. The method of claim 38 wherein the density of layer is uniform.

42. The method of claim 38 wherein the density of the layer is non-uniform.

43. The method of claim 38 wherein the resistance varies from the inlet to the outlet.

44. The method of claim 38 wherein the resistance increases from the inlet to the outlet.

* * * * *